US005467949A

United States Patent [19]

Lemke

[11] Patent Number: 5,467,949

[45] Date of Patent: Nov. 21, 1995

[54] CLAMPING HANGER FOR FOOD BAGS

[76] Inventor: Stuart H. Lemke, 349 River Bluff Dr., Mosinee, Wis. 54455

[21] Appl. No.: 232,840

[22] Filed: Apr. 25, 1994

[51] Int. Cl.[6] ..... B65B 67/12

[52] U.S. Cl. ..... 248/95; 24/563; 211/71; 248/316.7

[58] Field of Search ..... 248/95, 317, 316.7, 248/316.2, 316.3, 316.6; 211/89, 71; 24/563, 67.11, 545

[56] References Cited

U.S. PATENT DOCUMENTS

| | | | |
|---|---|---|---|
| 3,399,429 | 9/1968 | Goodman | 248/316.3 X |
| 3,600,764 | 8/1971 | Froehlich, Jr. | 24/54.5 |
| 4,356,600 | 11/1982 | Welch | 24/30.5 |
| 4,394,791 | 7/1983 | Groth | 24/30.5 |
| 4,629,075 | 12/1986 | Hutten | 211/89 |
| 4,641,756 | 2/1987 | Brown | 211/89 |
| 4,832,290 | 5/1989 | Baglio | 248/95 |
| 4,899,974 | 2/1990 | Wear et al. | 24/67.11 X |
| 4,998,630 | 3/1991 | Schwartz | 211/71 |

*Primary Examiner*—Ramon O. Ramirez
*Attorney, Agent, or Firm*—Andrus, Sceales, Starke & Sawall

[57] ABSTRACT

A clamping hanger is disclosed for sealing and storing a food bag having an end suspended from a support surface lying in a generally horizontal plane. The clamping hanger comprises a generally rectangular base adapted to be mounted to the support surface and a one-piece clamping member attached to the base. The clamping member has a pair of identical, arcuate-shaped, jaws converging together to form a mouth which enables the end of a food bag to be slidably received and retained therein.

2 Claims, 2 Drawing Sheets

FIG. 4
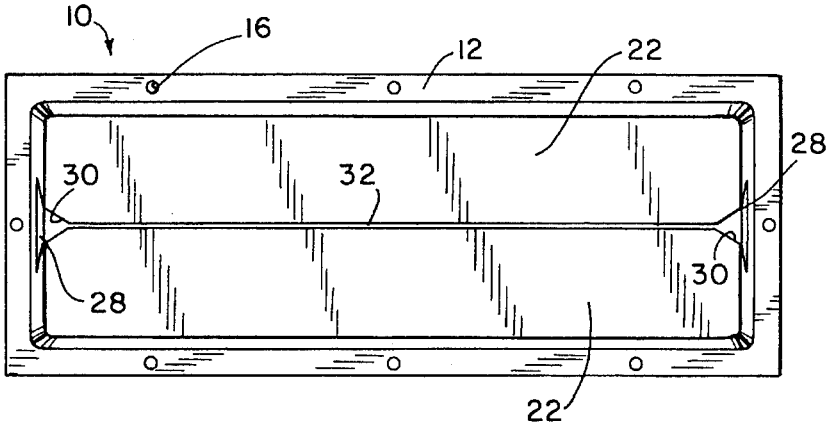
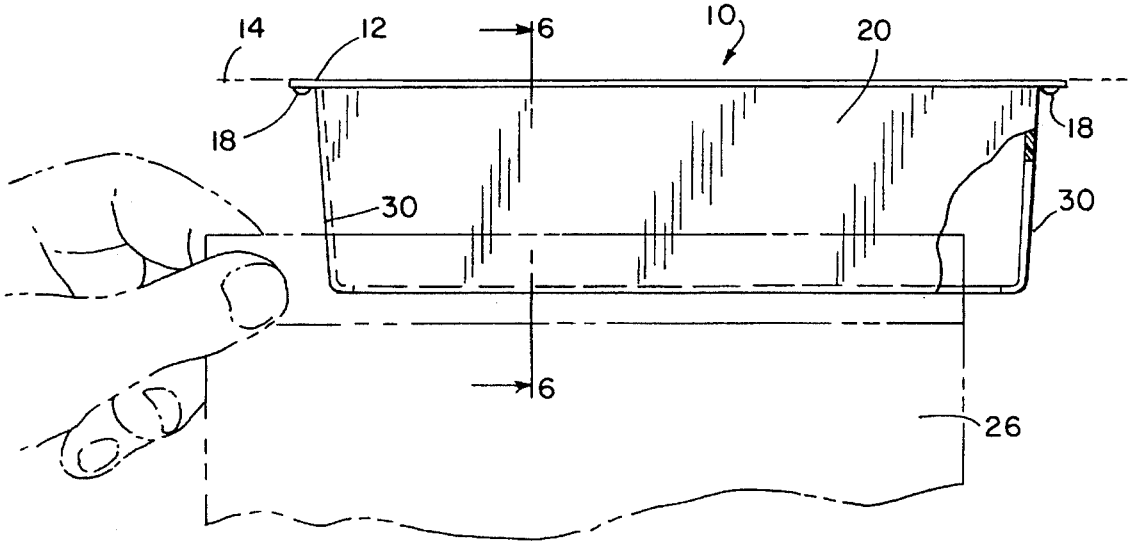
FIG. 5
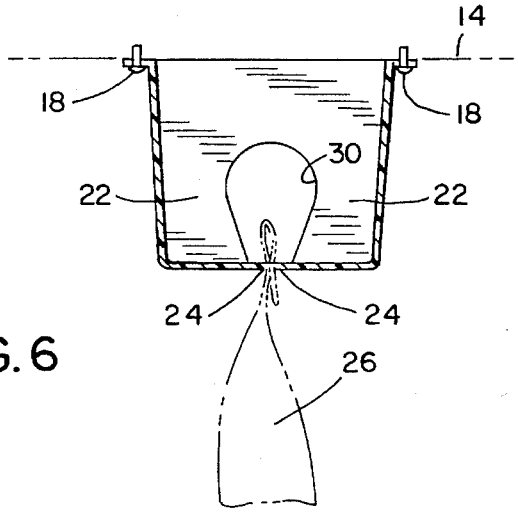
FIG. 6

CLAMPING HANGER FOR FOOD BAGS

FIELD OF THE INVENTION

This invention generally relates to closure devices for snack bags and the like and, more particularly, pertains to a clamping hanger for sealably retaining the end of a snack bag, such as a potato chip bag, and suspending it from a support surface.

BACKGROUND OF THE INVENTION

Food packagers currently provide a variety of food products, such as potato chips, cookies, and other such types of foods in sealed bags to preserve the freshness of the food until the bag is open by the consumer. Such bags have a composition and sealed closure such that the bag is frequently torn or destroyed at the end when it is opened. Due to its composition, the bag typically used resists folding or rolling and the bag presents a slippery external surface which is generally difficult to manipulate when closing the end of the bag. As a result, a consumer often discovers that the food is stale, untasty, and often wasted due to the bag not being properly closed and sealed. In order to avoid this undesirable experience, various bag closures, both separate from the bag and integral therewith, have been developed in the prior art. However, such closure devices, especially those of the clip-on type, have been unsatisfactory because of their cost or complexity and are generally inconvenient to handle and use. Integrating a closure device on an existing bag has proved to complicate the design of the bag from a marketing standpoint. In addition, it is unreasonably expensive to include such a closure device integrally constructed within the bag, which may only be captively used for that particular bag.

Accordingly, it is desirable to provide a bag clamping and support device which is simple and convenient to use, effective to create and maintain an air tight closure, and which can be utilized with various types of bags adapted to be suspended from a support surface.

SUMMARY OF THE INVENTION

The present invention advantageously provides an improved clamping hanger for food or snack bags which seals and closes the bag and may also serve as a hanger for supporting the bag from a support surface. The The improved clamping hanger is relatively simple, affordable, is easily applied to and removed from the bag and has versatility in a number of applications.

These and other advantages are realized in one aspect of the invention by a clamping hanger for sealing and storing a bag having an end adapted to be suspended from a support surface. The clamping hanger comprises a one-piece clamping member adapted to be mounted to the support surface. The clamping member has a pair of jaws converging together to form a mouth therebetween. The jaws have a length, a width and a depth, the length of the jaws being greater than the width or the depth. The mouth enables the end of a bag to be slidably received and retained therein.

In a highly preferred embodiment, the invention contemplates a clamping hanger for sealing and storing a food bag having an end with a thickness along which the food bag is suspended from a support surface lying in a generally horizontal plane. The clamping hanger comprises a generally rectangular base adapted to be mounted to the support surface and a one-piece clamping member attached to the base. The clamping member has a pair of identical, arcuate-shaped, substantially rigid jaws converging together to form a mouth. The mouth includes an enlarged guideway which gradually tapers into a slit having a width which is smaller than the thickness of the end of the food bag. The end of the food bag is received in the enlarged guideway and is slidably drawn along the slit for frictional retention therein.

BRIEF DESCRIPTION OF THE DRAWINGS

The invention will become better understood by reference to the following detailed description of the preferred exemplary embodiment when read in conjunction with the appended drawings wherein like numerals denote like elements and;

FIG. 4 is a top view of the clamping hanger shown in FIG. 2;

FIG. 5 is a view illustrating the use of the clamping member shown in FIG. 1; and FIG. 6 is a cross-sectional view taken on line 6—6 of FIG. 5.

DETAILED DESCRIPTION OF THE PREFERRED EMBODIMENTS

Figure 1:
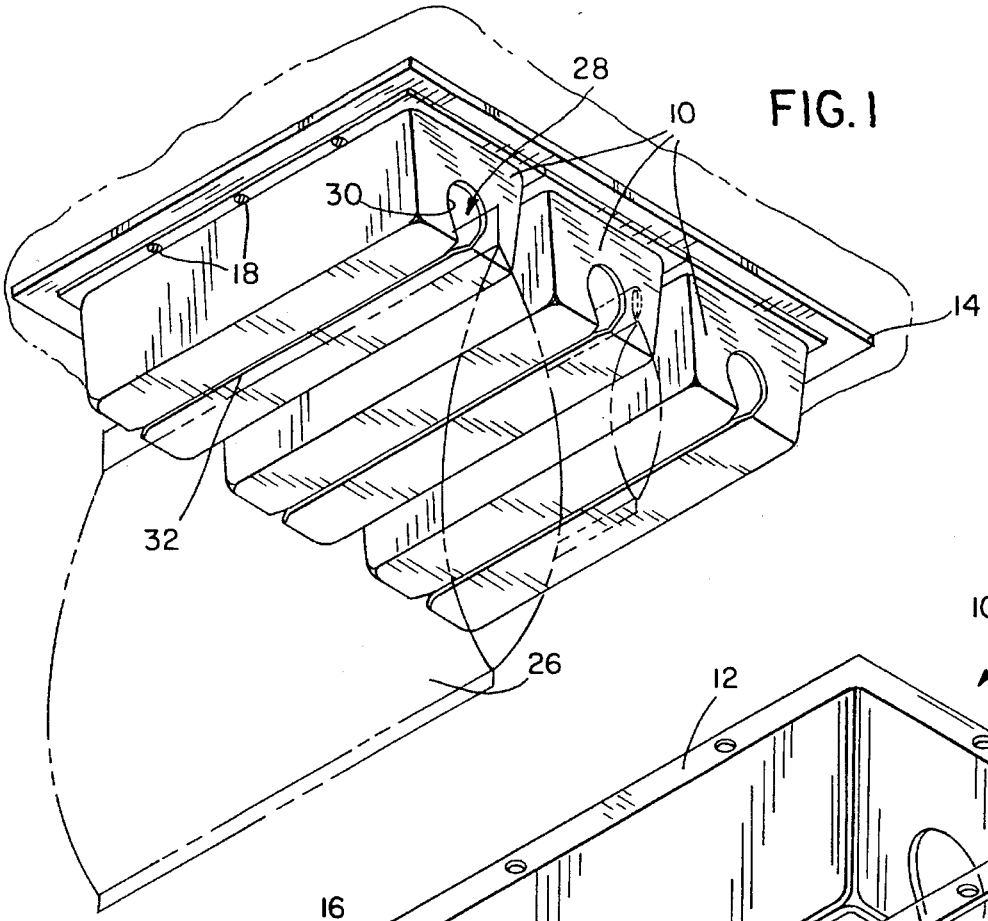
FIG. 1 is a perspective view of a clamping hanger embodying the invention and shown suspended in a linear array from a support surface.
Figure 2:
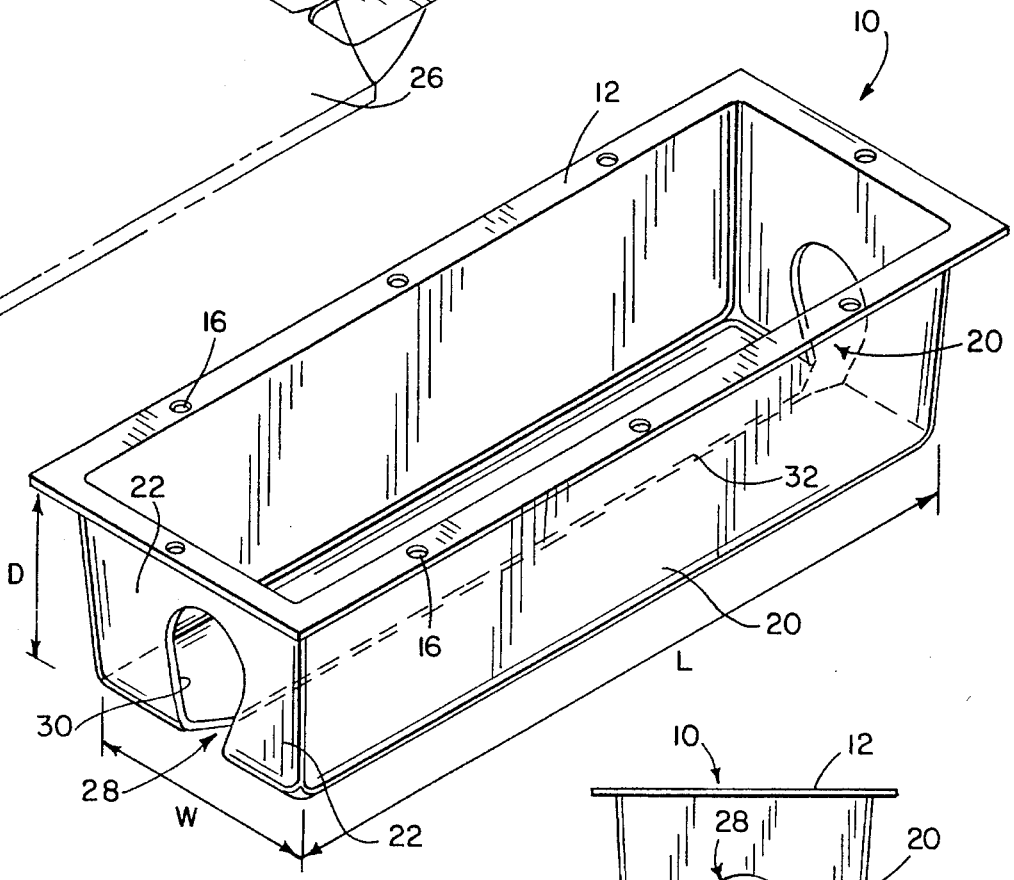
FIG. 2 is an isolated perspective view of a clamping hanger shown in FIG. 1.
Figure 3:
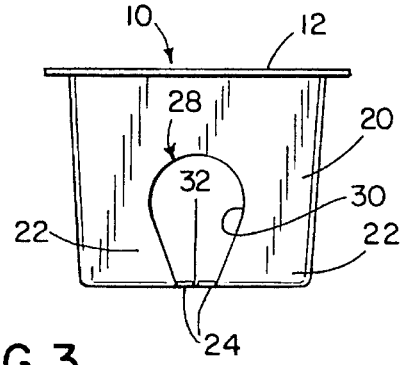
FIG. 3 is an end view of the clamping hanger shown in FIG. 2.

Referring now to the drawings, there is depicted an illustrative embodiment of the invention in a clamping hanger 10 for food bags and the like. In this preferred embodiment, the clamping hanger is especially useful for sealing a food bag and also for suspending it from a suitable support surface. Further, the clamping hanger of the present invention may be applied to various widths and types of food bags.

Clamping hanger 10 suitably comprises a flange defining a generally rectangular base 12 adapted to be mounted to a support surface 14 such as a cabinet shelf or the like, lying in a generally horizontal plane. The periphery of base 12 is formed with a plurality of apertures 16 through which complementary fasteners 18 may be screw threaded or otherwise affixed to support surface 14.

Integrally molded to base 12 is a one-piece clamping member 20 having a pair of identical, arcuate-shaped jaws 22, each of which has a length L greater than its depth D or width W. Jaws 22 are substantially rigid and are preferably fabricated as a unitary body of plastic by injection molding. In the preferred embodiment, a styrene plastic is used, but other materials would be satisfactory. Jaws 22 are provided with gripping members 24 which are adapted to engage opposite faces of the end of a food bag 26 disposed therebetween. Jaws 22 converge together to form a mouth 28 on each end of clamping member 10. Each mouth 28 has an enlarged guideway 30 which gradually tapers into a slit 32 having a width which is smaller than the thickness of the end of bag 26.

In use of clamping hanger 10, a consumer inserts the end of a food bag 26 in either enlarged guideway 30, as shown in FIG. 5, and thereafter the end of bag 26 is slidably drawn into and along slit 32 such that the reduced width of slit 32 will frictionally retain the end of food bag 26 therein while being suspended from the support surface 14. Food bag 26, which is to be closed by clamping hanger 10, may be folded or rolled at its open end if desired, but it is not necessary to do so. As such, it should be appreciated that clamping hanger 10 can be used with both unopened and opened food bags 26 as shown in FIG. 1. The frictional force of food bag 26 sandwiched between gripping members 24 on either side of slit 32 tends to seal the bag 26 and affords a sufficient gripping action that food bag 26 may be hung from clamping hanger 10, either singly or in a linear array of desired food products.

It should be appreciated that the clamping hanger of the present invention can be utilized on all types of bags and that the length of the jaws can be varied to accommodate any size and type of bag. Further, it should be understood that the present invention is relatively simple and inexpensive, is lightweight and durable, and can be easily and conveniently used and manufactured. The clamping hanger of the present invention is particularly effective to keep food such as potato chips, cookies, crackers and other snacks fresh for a prolonged period.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with respect to the following claims.

I claim:

1. A clamping hanger for sealing and storing a food bag having an end with a thickness along which the food bag is suspended from a support surface lying in a generally horizontal plane, said clamping hanger comprising:

a generally rectangular base adapted to be mounted to the support surface; and a one-piece clamping member attached to said base, said clamping member having a pair of identical, arcuate-shaped, substantially rigid jaws converging together to form a mouth, said mouth having an enlarged guideway gradually tapering into a slit, said slit having a width smaller than the thickness of the end of the food bag, such that the end of the food bag is received in said enlarged guideway and slidably drawn along said slit for frictional retention therein.

2. The clamping hanger as recited in claim 1, wherein said clamping member has end portions, each of which is provided with said enlarged guideway.

* * * * *